US006832553B2

(12) United States Patent
Usui

(10) Patent No.: US 6,832,553 B2
(45) Date of Patent: Dec. 21, 2004

(54) PRINTING METHOD OF PLANOGRAPHIC PRINTING PLATE AND PLANOGRAPHIC PRINTING PLATE PROCESSED BY THIS METHOD

(75) Inventor: Takayuki Usui, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/140,217

(22) Filed: May 8, 2002

(65) Prior Publication Data

US 2002/0195013 A1 Dec. 26, 2002

(30) Foreign Application Priority Data

May 11, 2001 (JP) ..... 2001-141909

(51) Int. Cl.[7] ..... B41N 3/03

(52) U.S. Cl. ..... 101/465; 101/454; 101/458; 101/463.1

(58) Field of Search ..... 101/458, 459, 101/465, 453, 454, 463.1

(56) References Cited

U.S. PATENT DOCUMENTS

| | | | | |
|---|---|---|---|---|
| 3,615,630 A | | 10/1971 | Dietrich | 430/270.1 |
| 4,075,015 A | | 2/1978 | Vinkovic et al. | 430/282.1 |
| 4,272,604 A | | 6/1981 | Meador et al. | 430/159 |
| 4,399,243 A | * | 8/1983 | Dixit et al. | 524/55 |
| 5,219,687 A | | 6/1993 | Suzuki et al. | 430/49 |
| 5,314,787 A | | 5/1994 | Elsaesser et al. | 430/302 |

FOREIGN PATENT DOCUMENTS

| | | |
|---|---|---|
| EP | 0113521 A2 | 11/1993 |
| JP | 59-097146 | 4/1984 |

* cited by examiner

*Primary Examiner*—Daniel J. Colilla
*Assistant Examiner*—Jill E. Culler
(74) *Attorney, Agent, or Firm*—Sughrue Mion, PLLC

(57) ABSTRACT

The present invention provides a method for printing, comprising the steps of: a) developing an image forming surface of a planographic printing plate; b) after the developing, hydrophilizing a portion of a vicinity of an edge of the image forming surface; c) after the hydrophilizing, adhering ink to the image forming surface; and d) transferring the ink to a printing target.

18 Claims, No Drawings

PRINTING METHOD OF PLANOGRAPHIC PRINTING PLATE AND PLANOGRAPHIC PRINTING PLATE PROCESSED BY THIS METHOD

BACKGROUND OF THE INVENTION

1. Field of the Invention

The present invention relates to a printing method comprising the steps of developing a planographic printing plate, adhering ink to the planographic printing plate, and transferring the ink to a printing target, and to a planographic printing plate which has been processed by the above printing method.

2. Description of the Related Art

In the recent plate-making method (including xerographic plate-making method), in order to facilitate automation of a plate-making process, a planographic printing plate such as a photosensitive printing plate or a heat-sensitive printing plate is widely used. Generally, the planographic printing plate is manufactured such that surface treatments such as a graining treatment, an anodic oxidation treatment, a silicate treatment, and a chemical conversion treatment are conducted on a support such as a sheet-type or coiled aluminum plate singly or appropriately in combination. Then, the surface-treated support is coated with a photosensitive layer or a heat-sensitive layer (which is collectively referred to as a "coating film", and a surface applied with the coating film is referred to as an "image forming surface", a surface unapplied with the coating film is referred to as a "non-image forming surface").

The planographic printing plate is subjected to image-forming treatments such as an exposure treatment, a development treatment, and a gumming treatment. The planographic printing plate for which the image-forming treatments have been completed is set in a printer, and then ink is applied thereto. Accordingly, characters, images and the like are printed on a paper surface which is a printing target.

If the printing target is large (as in a case of a newspaper or the like, for example), there is a case of using the planographic printing plate which is smaller than the printing target. In this case, since an edge of the planographic printing plate is located at the inner side of that of the printing target, if ink is unexpectedly deposited on the edge portion of the planographic printing plate, the ink is transferred onto the printing target, whereby so-called "edge-stain" is caused. If the edge-stain is produced, dots or lines appear at portions other than characters or patterns that should be primarily printed, whereby printing quality of the printing target deteriorates.

In order to prevent such edge-stain as described above, a method in which edge portions (corner portions) of an aluminum support of the planographic printing plate are shaved off by a file or knife is disclosed in Japanese Patent Application (Laid-Open) JP-A No. 59-97146. In this way, if the edge portions of a planographic printing plate are shaved, the edge portions do not come into contact with the printing target, and ink depositing on the edge portions is not transferred onto the printing target, whereby edge-stain can be prevented.

An operation of shaving off the edge portions of the planographic printing plate involves shaving off an aluminum support, which requires lots of time and labor. Further, since the edge portions must be shaved off for each of the planographic printing plates which have been cut to a desired size, if the edge portions of supports of a great number of the planographic printing plates are shaved off, further more time and labor are required.

It is possible to carry out the shaving-off operation on the edge portions of the planographic printing plate on a general processing line thereof. However, a cutting slitter or cutter must be switched to another one as necessary (or based on the size of the planographic printing plate). Before or after the switching operation, some of the planographic printing plates may become unavailable as products, leading to the waste of materials for the planographic printing plates. In addition, during the switching operation, since the processing line must be stopped, it becomes impossible to process the planographic printing plates, thus wasting time.

SUMMARY OF THE INVENTION

In view of the foregoing, an object of the present invention is to provide a printing method of a planographic printing plate and a planographic printing plate processed by this method, which is able to ensure that edge-stain can be prevented without requiring much time and labor.

In order to accomplish the above-described objects, the present invention provides a method for printing, comprising the steps of: a) developing an image forming surface of a planographic printing plate; b) after the developing, hydrophilizing a portion of a vicinity of an edge of the image forming surface; c) after the hydrophilizing, adhering ink to the image forming surface; and d) transferring the ink to a printing target.

In the present invention, the step of hydrophilizing is conducted on the portion in the vicinity of the edge of the image forming surface of the planographic printing plate for which the step of developing has been completed and for which the step of adhering ink is not completed. Thereafter, the image forming surface of the planographic printing plate is deposited with ink. The ink is transferred, for example, onto a rubber blanket and then transferred to the printing target such as paper (otherwise, the ink may be directly transferred onto the printing target). Ink does not easily deposit on the portion in the vicinity of the edge of the image forming surface (preferably, ink never deposits on the portion in the vicinity of the edge), whereby edge-stain is prevented from being produced on the printing target.

In the present invention, since a shaving-off operation of portions of the support of the planographic printing plate is not required and the developed planographic printing plate can be used in a printer as it is, time and labor can be saved. Further, since it is not necessary to carry out a switching operation on the processing line of the planographic printing plate, materials for the planographic printing are not wasted.

In printing using the planographic printing plate, there is a case in which a gum solution is applied to the developed planographic printing plate. In this case, the step of hydrophilizing can be performed after or before the step of applying the gum solution. Generally, since the step of developing and the step of applying the gum solution are often conducted by one developing apparatus (printing processor in a broad sense), when the step of hydrophilizing is conducted after the step of applying the gum solution, the conventional developing apparatus need not be modified and can be used as it is. On the contrary, there is a case in which it is considered to be preferable to apply the gum solution to the planographic printing plate which has been hydrophilized. Accordingly, in this case, if a system is adopted in which the step of hydrophilizing is conducted before the step of applying the gum solution (i.e., the planographic printing plate is developed, hydrophilized, and applied with the gum solution), the number of steps in the entire printing can be reduced a great deal.

A portion to be hydrophilized is not limited as long as edge-stain is not produced in the portion. However, for example, it is preferable that a width of the portion to be hydrophilized is no more than 3 mm from the edge of the image forming surface of the planographic printing plate. Namely, if the width of the portion to be hydrophilized is no more than 3 mm, a broad region for forming an image can be secured.

DESCRIPTION OF THE PREFERRED EMBODIMENTS

A detailed description of an embodiment of the present invention will be given hereinafter.

A planographic printing plate used in the present invention is not particularly specified, and a planographic printing plate conventionally used is applicable to the present invention.

The planographic printing plate has a rectangular plate-shaped thin aluminum support, and a coating film (a photosensitive printing plate is coated with a photosensitive layer, a heat-sensitive printing plate is coated with a heat-sensitive layer, and which coating film is sometimes coated with an overcoat layer or a mat layer as necessary) coated on this support. Plate-making treatment such as an exposure treatment, a development treatment, and a gumming treatment are conducted on the coating film. The planographic printing plate thus obtained is set in a printer, ink is applied thereto, and characters and images are printed on a paper surface. The planographic printing plate before going through the treatments (such as exposure treatment, development treatment, and the like) required for printing is especially referred to as a "planographic printing plate precursor" or a "planographic printing material", and may be differentiated from the processed planographic printing plate. The planographic printing plate is sorted into two types: a so-called "one surface-coated product" having the coating film at only one surface of the support and a so-called "both surfaces-coated product" having the coating film at both surfaces of the support. An "image forming surface" of the planographic printing plate of the present invention generally represents the surface applied with the coating film. Only one surface of the support becomes an image forming surface in the case of the one surface-coated product, while both surfaces of the support become image forming surfaces in the case of the both surfaces-coated product.

If the planographic printing plate is structured as described above, the concrete structure of the planographic printing plate is not specifically limited. However, if a planographic printing plate for a laser plate-printing in a heat-mode system or a photon-system is used, the planographic printing plate can be plate-made directly from digital data.

A planographic printing plate is able to correspond to various plate-making methods by selecting suitable components in the photosensitive layer or the heat-sensitive layer. Examples of specified embodiments of the planographic printing plate according to the present invention include embodiments from (1) to (11) described below:

(1) An embodiment in which the photosensitive layer contains an infrared absorbent, a compound that generates an acid due to heat, and a compound that cross-links due to the acid;

(2) An embodiment in which the photosensitive layer contains an infrared absorbent and a compound which becomes alkali soluble due to heat;

(3) An embodiment in which the photosensitive layer includes two layers: a layer contains a compound that generates a radical due to the irradiation of laser light, an alkaline soluble binder, and a multifunctional monomer or prepolymer, and an oxygen block layer;

(4) An embodiment in which the photosensitive layer includes two layers: a physical development nucleus layer and a silver halide emulsion layer;

(5) An embodiment in which the photosensitive layer includes three layers: a polymerization layer containing therein a multifunctional monomer and a multifunctional binder, a layer containing therein a silver halide and a reductant, and an oxygen block layer;

(6) An embodiment in which the photosensitive layer includes two layers: a layer containing therein a novolak resin and naphthoquinone diazide, and a layer containing therein a silver halide;

(7) An embodiment in which the photosensitive layer includes an organic photoconductor;

(8) An embodiment in which the photosensitive layer includes two or three layers: a laser light absorbing layer that is removed by the irradiation of laser light, and a lipophilic layer and/or a hydrophilic layer;

(9) An embodiment in which the photosensitive layer includes a compound (an acid generator) that generates an acid due to absorption of energy, a high polymer compound having at the side chains thereof the functional groups that generate a sulfonic acid or a carboxylic acid due to the acid, and a compound which implies energy to the acid generator by the absorption of visible light;

(10) An embodiment in which the photosensitive layer contains a quinone diazide compound and a novolak resin; and

(11) An embodiment in which the photosensitive layer contains a compound which decomposes due to light or UV light to form a cross-linking structure with the compound itself or with other molecules contained in the photosensitive layer and an alkali soluble binder.

Particularly, in recent years, a planographic printing plate comprising a photosensitive type coating film with high sensitivity which coating film is exposed with laser light or a heat-sensitive type planographic printing plate (for example, the embodiments (1) to (3) described above) is used.

Wavelengths of laser light described herein are not particularly limited, and examples of the wavelengths of the laser light include:

① A laser having a wavelength region from 350 to 450 nm (as a specific example, a laser diode having a wavelength of 405±5 nm);

② A laser having a wavelength region from 480 to 540 nm (as a specific example, an argon laser having a wavelength of 488 nm, a (FD) YAG laser having a wavelength of 532 nm, a solid-state laser having a wavelength of 532 nm, and a (green) He—Ne laser having a wavelength of 532 nm);

③ A laser having a wavelength region from 630 to 680 nm (as a specific example, He—Ne laser having a wavelength of 630 to 670 nm and a red semiconductor laser having a wavelength of 630 to 670 nm);

④ A laser having a wavelength region from 800 to 830 nm (as a specific example, an infrared (semiconductor) laser having a wavelength of 830 nm); and ⑤ A laser having a wavelength region from 1064 to 1080 nm (as a specific example, a YAG laser having a wavelength of 1064 nm).

Among these, both laser lights within the wavelength regions of ② and ③ are applicable to both of the planographic printing plates each having the photosensitive layer or the heat-sensitive layer of the embodiment (3) or (4). Further, both of the laser lights within the wavelength regions in the ④ and ⑤ are applicable to both of the planographic printing plates each having the photosensitive layer or the heat-sensitive layer in the embodiment (1) or (2). It is a matter of course that relationships between wavelength regions of laser lights and the photosensitive layer or the heat-sensitive layer are not limited to these.

The planographic printing plate according to the present embodiment (i.e., the planographic printing plate according to all of the embodiments from (1) to (11) described above) may be set in an automatic plate-making apparatus that is equipped with an automatic plate-feeding mechanism, a so-called plate-setter, or the like, and supplied (fed) to a plate-making treatment. In the actual situation in which the planographic printing plate is used, the aforementioned planographic printing plate is applicable to the printing method of the present invention, regardless of whether or not the user feeds the planographic printing plate by using the automatic plate-feeding mechanism or whether or not the user feeds the planographic printing plate manually (in other words, as a problem preceding to a plate-feeding method). Even if a planographic printing plate according to an embodiment other than the above-described embodiments (1) to (11), all of the planographic printing plates can be incorporated in the planographic printing plate according to the present embodiment as long as they can be set in the automatic plate-making apparatus or a so-called plate-setter which is equipped with the automatic plate-feeding mechanism, and then supplied (fed) to the plate-making treatment.

Some of the planographic printing plates are referred to as a so-called "sub-plate" or "blank plate". Each of such planographic printing plates is set at a position unapplied with ink (i.e., in a region in which images are not printed) and used in accordance with the interior conditions of a printer in use. Ordinarily, ink is not applied to the sub-plate or the blank plate, however, a case that ink deposits on the sub-plate or the blank plate temporarily and unexpectedly can be assumed. Further, there is a case in which a gum solution is applied to the blank plate regardless of whether or not ink is depositing on the blank plate. The planographic printing plate according to the present invention extensively comprises not only a planographic printing plate in which ink is deposited on the planographic printing plate and the ink is then transferred onto the paper surface but also a planographic printing plate in a case in which it is not preferred to transfer ink that has unexpectedly deposited on the edge portions of the planographic printing plate onto the paper surface, regardless of whether or not ink is acceptably deposited on the planographic printing plate or whether or not the gum solution is applied to the planographic printing plate (accordingly, the present invention also comprises the above-described "sub-plate" or "black plate").

A planographic printing plate can be formed into any configuration, for example, a planographic printing plate may have the photosensitive layer or the heat-sensitive layer applied to one surface of an aluminum plate whose thickness is from 0.1 to 0.5 mm, whose long side (width) is from 300 to 2050 mm, and whose short side (length) is from 200 to 1500 mm. The printing method of the planographic printing plate of the present invention is preferably used for printing using a planographic printing plate which is smaller than the printing target, namely, a planographic printing plate having a size in which at least a portion (for example, one side) of the edge of the planographic printing plate is located at inner side of the edge of the printing target.

In the present invention, such a planographic printing plate is used to print images such as characters or patterns on the paper surface as the printing target. However, a process in which a latent image is formed on the planographic printing plate and the latent image is developed can be carried out in the same manner as the conventional method.

After the step of developing, a portion in the vicinity of the edge of the planographic printing plate is hydrophilized. Examples of a method of hydrophilizing include a method of applying a hydrophilic compound, a method of applying a silicate compound, and a method of applying a cleaner to be used for an image forming surface (i.e., a so-called "plate cleaner) can be used, but a method of hydrophilizing is not limited to these.

Examples of the hydrophilic compound can include aqueous solutions in which hydrophilic organic high molecular compounds are contained. Examples of the hydrophilic organic high molecular compounds include: gum arabic, gum soya, carboxymethylcellulose, carboxyethylcellulose, hydroxymethylcellulose, hydroxyethylcellulose, polyhydroxy ethylated cellulose, hydroxypropylcellulose, hydroxypropylmethylcellulose, glyoxallized hydroxypropylmethylcellulose, hydroxypropylmethylcellulose phthalate, methylcellulose, α-cyclodextrin, β-cyclodextrin, γ-cyclodextrin, white dextrin, red dextrin, pullulan, enzymolyzed etherified dextrin, maltosed cyclodextrin, alphated starch, graftified starch, dialdehyde starch, periodic acid degenerated starch, hydroxyether modified starch, cation starch ether, alkali cellulose, an alginic acid, sodium alginate, ammonium alginate, propylene glycol alginate, xanthene gum, corn starch, industrial acid modified corn starch, industrial acidified corn starch, industrial cation corn starch, polyvinyl alcohol, polyvinyl pyrolidone, polyacryl amide, an aqueous soluble copolymer containing acryl amide unit, a polyacrylic acid, a copolymer containing acrylic acid unit, a polymethacrylic acid, a copolymer containing methacrylic acid unit, copolymer of vinyl ethyl ether and maleic anhydride, phosphoric acid modified starch, and the like.

Examples of the silicate compound include: sodium silicate; a so-called No. 1 sodium silicate (whose ratio of $SiO_2$ to $Na_2O$ is 1:1); and a so-called No. 3 sodium silicate (whose ratio of $SiO_2$ to $Na_2O$ is 1:3).

Examples of the component which is contained in the plate cleaner and which contributes to the effects of the present invention include: sodium hexamethaphosphate; a phosphoric acid, magnesium nitrate, gum arabic, and the like. More specific examples of the plate cleaners include: PS multicleaner MC, PS Paste Cleaner PC-1, and PS plate cleaner CN-4 (manufactured by Fuji Photo Film Co., Ltd.), Cleaner Ace (manufactured by Ueno Co. Ltd.), Noris Plate Cleaner (manufactured by Iwaki Sangyo Co., Ltd.), Ultra Plate Cleaner, Everyday Plate Cleaner, Hydro Image Plate Cleaner, and SK Plate Cleaner (manufactured by SK Liquid manufacturing Co., Ltd.), Sun Paste Cleaner (manufactured by Koyo Chemical Co., Ltd.), SS Super Plate Cleaner A (manufactured by Seishin Shoji Co., Ltd.), Ultra Plate Cleaner (Dainichiseikasha Colour & Chemicals Mfg. Co., Ltd.), and the like. However, the plate cleaner are not limited to these products.

A method of applying at least one of these solutions to the planographic printing plate is not particularly limited. However, for example, these solutions can be applied by using a brush or the like or transferred and applied by using a roller (such as a sponge roller with an aqueous solution immersed). If the viscosity of the aqueous solution is low, the solution can be atomized and applied by using a spray or the like. Further, these solutions can be applied by passing the planographic printing plate through the solution atmosphere.

After hydrophilizing, the planographic printing plate is deposited with ink in the same manner as a conventional printing method. At this point, since the portion in the vicinity of the edge of the planographic printing plate is hydrophilized, ink does not deposit thereon.

After the planographic printing plate deposited with ink has been kept into contact with a rubber blanket or the like to transfer the ink onto the rubber blanket, the rubber blanket and the printing target such as the paper surface are further kept into contact with each other to thereby record images such as the desired characters or patterns on the printing target. Depending on a case, the planographic printing plate deposited with ink can be directly kept into contact with the printing target without contacting the planographic printing plate having ink deposited thereon with the rubber blanket, whereby the ink is transferred onto the printing target. In both cases, since the portion in the vicinity of the edge of the planographic printing plate is not deposited with ink, the ink is not transferred from the edge portion of the planographic printing plate onto the printing target thus preventing so-called edge-stain from occurring. In particular, as in a case of a newspaper or the like, if the printing target is larger than the planographic printing plate, at least a portion of the entire edge of the planographic printing plate is located at the inner side of the edge of the printing target. However, since the edge of the planographic printing plate is not deposited with ink, edge-stain can be prevented. As a matter of fact, unless it is limited to newspaper printing, if the printing target is larger than the planographic printing plate, it is possible to prevent edge-stain by using the printing method of the planographic printing plate according to the present invention.

In the present invention, an operation for shaving off an aluminum support of the planographic printing plate which operation was needed for a conventional printing method of the planographic printing plate is not required, thus making it possible to use a planographic printing plate in general use (which is strictly referred to as a planographic printing plate precursor or a planographic printing plate material), whereby time and labor can be reduced. In particular, when a great number of the planographic printing plates are processed, they can be processed at less time and labor, resulting in a low cost. Further, if the processing lines of the planographic printing plate are used to obtain a desired size of the planographic printing plate, it is not needed to switch the processing lines, whereby materials for the planographic printing plate are not wasted.

During the printing method, in order to increase printing resistance of the planographic printing plate and protect non-image portions of the planographic printing plate after the developing of the planographic printing plate, there is a case in which the gum solution is applied on the planographic printing plate (a so-called "gumming"). In this case, the step of hydrophilizing can be conducted before or after the step of applying the gum solution. Typically, since the step of developing and the step of applying the gum solution are conducted by the same developing apparatus (i.e., a printing processor in a broad sense) in many cases, when the step of hydrophilizing is conducted after the step of applying the gum solution, there is no need to modify this developing apparatus, whereby existing equipment can be used as it is. Meanwhile, there is a case in which it is preferable to apply the gum solution after the step of hydrophilizing. Consequently, in this case, if the step of hydrophilizing is conducted before the step of applying the gum solution (namely, the step of hydrophilizing is conducted after the development, and the gum solution is then applied on the planographic printing plate), the number of steps for the entire processing method can be lessened.

A width of a region to be hydrophilized (i.e., width of the portion to be hydrophilized that is measured from the nearest edge of the planographic printing plate) is not particularly limited as long as the edge-stain is prevented. However, the width is preferably no more than 3 mm. Namely, if the width of the region to be hydrophilized is no more than 3 mm, a substantially broad region can be secured for forming images in the region. In view of the above-description, the width is more preferably no more than 2 mm, and most preferably no more than 1 mm. Edge-stain is often produced within a range of about 0.5 mm from the edge of the planographic printing plate. Accordingly, if the width of the region to be hydrophilized is about 1 mm, edge-stain can be prevented.

In Table 1, a relationship between a width of a region to be hydrophilized (i.e., a hydrophilized portion width), edge-stain and image qualities in vicinities of imaged portions are shown (cases 1 to 3). Further, a relationship between edge-stain and the image qualities in the vicinities of the imaged portions unless the planographic printing plate is hydrophilized (case 4).

TABLE 1

| | | Hydrophilized | | Image qualities in vicinities of imaged portion (Distance from edge) | | |
|---|---|---|---|---|---|---|
| | Hydrophilizing | portion width (mm) | Edge-stain | 3 mm or more | 2 mm or more | 1 mm or more |
| Case 1 | Hydrophilized | 1 | Unseen | Superior | Superior | Superior |
| Case 2 | Hydrophilized | 2 | Unseen | Superior | Superior | Inferior |
| Case 3 | Hydrophilized | 3 | Unseen | Superior | Inferior | Inferior |
| Case 4 | Not Hydrophilized | — | Seen | Superior | Superior | Superior |

In table 1, "Image qualities in vicinities of imaged portion" are comparatively evaluated by observing images qualities in vicinities of imaged portions of prints obtained by using the planographic printing plate at inner distances of 3 mm or more, 2 mm or more, and 1 mm or more from the edge of a planographic printing plate.

As is apparent from table 1, in the cases 1 to 3 in which the planographic printing plate is hydrophilized, it is understood that edge-stain did not occur. Namely, in the case 3 in which the hydrophilized portion width is 3 mm, image quality becomes superior at an inner distance of 3 mm or more from the edge of the planographic printing plate, in the case 2 in which the hydrophilized portion width is 2 mm, image quality becomes superior at an inner distance of 2 mm or more from the edge of the planographic printing plate, and in the case 1 in which the hydrophilized portion width is 1 mm, image quality becomes superior at an inner distance of 1 mm or more from the edge of the planographic printing plate. Namely, also from this table, it is understandable that the hydrophilized portion width is preferably no more than 2 mm, and more preferably no more than 1 mm.

Similarly from table 1, it is noted that in the case 4 in which the planographic printing plate is not hydrophilized, edge-stain may occur.

What is claimed is:

1. A method for printing, comprising the steps of:

developing an image forming surface of a planographic printing plate;

after said developing, hydrophilizing a portion of a vicinity of an edge of the image forming surface;

after said hydrophilizing, adhering ink to the image forming surface;

transferring the ink to a printing target; andapplying a gum solution onto the planographic printing plate, wherein the step of hydrophilizing is performed after the step of applying a gum solution.

2. The method of claim 1, wherein the hydrophilized portion extends no more than 3 mm from the edge.

3. The method of claim 1, wherein the hydrophilized portion extends no more than 2 mm from the edge.

4. The method of claim 1, wherein the hydrophilized portion extends no more than 1 mm from the edge.

5. The method of claim 1, wherein the hydrophilization is conducted by applying a hydrophilic compound.

6. The method of claim 1, wherein the hydrophilization is conducted by applying a silicate compound.

7. The method of claim 1, wherein the hydrophilization is conducted by applying a plate cleaner.

8. A method for printing, comprising the steps of:

developing an image forming surface of a planographic printing plate;

after said developing, hydrophilizing a portion of the image forming surface, said portion is in a vicinity of an edge of the image forming surface;

after said hydrophilizing, adhering ink to the image forming surface;

transferring the ink to a printing target; and applying a gum solution onto the planographic printing plate, wherein the step of hydrophilizing is performed before the step of applying a gum solution;

wherein the hydrophilized portion extends no more than 3 mm from the edge.

9. The method of claim 8, wherein the hydrophilized portion extends no more than 2 mm from the edge.

10. The method of claim 8, wherein the hydrophilized portion extends no more than 1 mm from the edge.

11. The method of claim 8, wherein the hydrophilization is conducted by applying a hydrophilic compound.

12. The method of claim 8, wherein the hydrophilization is conducted by applying a silicate compound.

13. The method of claim 8, wherein the hydrophilization is conducted by applying a plate cleaner.

14. A planographic printing plate comprising:

a support having one surface coming into contact with a printing target during printing;

a hydrophilic coating which is disposed in vicinities of edges of the one surface; and a gum coating, wherein said hydrophilic coating is disposed over at least a part of the gum coating.

15. The planographic printing plate of claim 14, further comprising on the one surface of the support a developed coating film which includes an image forming surface.

16. The planographic printing plate of claim 14, wherein the hydrophilic coating extends no more than 3 mm past said edges.

17. A planographic printing plate comprising:

a support having one surface coming into contact with a printing target during printing;

a hydrophilic coating which is disposed on portions of the one surface, said portions are in vicinities of edges of the one surface;

a gum coating, wherein the gum coating covers the hydrophilic coating; and wherein the hydrophilic coating extends no more than 3 mm past said edges.

18. The planographic printing plate of claim 17, further comprising on the one surface of the support a developed coating film which includes an image forming surface.

* * * * *